US010895415B2

(12) United States Patent
Haenssler et al.

(10) Patent No.: US 10,895,415 B2
(45) Date of Patent: Jan. 19, 2021

(54) SHELF FOR DOMESTIC REFRIGERATION APPLIANCE AND DOMESTIC REFRIGERATION APPLIANCE

(71) Applicant: BSH HAUSGERAETE GMBH, Munich (DE)

(72) Inventors: Felix Haenssler, Langenau (DE); Daniel Bassler, Aalen (DE); Robert Briem, Laichingen (DE)

(73) Assignee: BSH Hausgeraete GmbH, Munich (DE)

( * ) Notice: Subject to any disclaimer, the term of this patent is extended or adjusted under 35 U.S.C. 154(b) by 94 days.

(21) Appl. No.: 16/150,923

(22) Filed: Oct. 3, 2018

(65) Prior Publication Data

US 2019/0107321 A1 Apr. 11, 2019

(30) Foreign Application Priority Data

Oct. 5, 2017 (DE) ..... 10 2017 217 655

(51) Int. Cl.

| | |
|---|---|
| ***F25D 25/02*** | (2006.01) |
| ***F25D 17/06*** | (2006.01) |
| ***F25D 17/04*** | (2006.01) |
| ***F25D 11/00*** | (2006.01) |

(52) U.S. Cl.

CPC ..... *F25D 25/028* (2013.01); *F25D 17/04* (2013.01); *F25D 17/062* (2013.01); *F25D 25/02* (2013.01); *F25D 25/021* (2013.01); *F25D 2317/063* (2013.01); *F25D 2317/066* (2013.01); *F25D 2325/021* (2013.01); *F25D 2325/022* (2013.01)

(58) Field of Classification Search

CPC ..... F25D 25/028; F25D 25/02; F25D 17/062; F25D 25/021; F25D 17/04; F25D 2317/066; F25D 2325/022; F25D 2325/021; F25D 2317/063; F25D 17/045; F25D 11/00

USPC ..... 62/440

See application file for complete search history.

(56) References Cited

U.S. PATENT DOCUMENTS

| | | | | |
|---|---|---|---|---|
| 4,671,074 | A * | 6/1987 | Gostelow | F25D 17/065 62/186 |
| 6,779,357 | B1 | 8/2004 | Fann | |
| 2003/0222044 | A1* | 12/2003 | Maritan | F25D 25/02 211/153 |
| 2008/0156020 | A1* | 7/2008 | Shin | F25D 17/065 62/340 |
| 2010/0024446 | A1* | 2/2010 | Rohrer | A47F 3/0447 62/89 |

FOREIGN PATENT DOCUMENTS

| | | | |
|---|---|---|---|
| CN | 1474148 | A | 2/2004 |
| CN | 102128534 | A | 7/2011 |
| CN | 205373207 | U | 7/2016 |
| EP | 1447633 | A2 | 8/2004 |

* cited by examiner

*Primary Examiner* — Steve S Tanenbaum

(74) *Attorney, Agent, or Firm* — Laurence A. Greenberg; Werner H. Stemer; Ralph E. Locher

(57) ABSTRACT

A shelf for a domestic refrigeration appliance includes an upper cover plate, a lower cover plate and a frame in which the cover plates are disposed. An intermediate space is formed between the cover plates as a thermally insulated space. A channel for conducting media is provided in the frame separately from the intermediate space. A domestic refrigeration appliance having the shelf is also provided.

13 Claims, 2 Drawing Sheets

SHELF FOR DOMESTIC REFRIGERATION APPLIANCE AND DOMESTIC REFRIGERATION APPLIANCE

CROSS-REFERENCE TO RELATED APPLICATION

This application claims the priority, under 35 U.S.C. § 119, of German Patent Application DE 10 2017 217 655.5, filed Oct. 5, 2017; the prior application is herewith incorporated by reference in its entirety.

BACKGROUND OF THE INVENTION

Field of the Invention

The invention relates to a shelf for a domestic refrigeration appliance having an upper cover plate, a lower cover plate and a frame in which the cover plates are disposed, an intermediate space is formed between the cover plates as a thermally insulated space. Moreover, the invention further relates to a domestic refrigeration appliance having at least one such shelf.

Embodiments of a shelf, which is configured from two superimposed and spaced-apart cover plates, are disclosed for example in European Patent Application EP 1 447 633 A2, corresponding to U.S. Pat. No. 6,779,357. The cover plates are disposed on top of one another and thermally insulating material may be introduced into an intermediate space. The cover plates are encompassed by a frame.

In the embodiment disclosed therein, while the shelf is constructed to be multifunctional, since it is configured for depositing goods to be stored thereon and at the same time the thermally insulating material is also able to constitute a thermal partition, the further functionality of the shelf is limited.

SUMMARY OF THE INVENTION

It is accordingly an object of the invention to provide a shelf for a domestic refrigeration appliance and a domestic refrigeration appliance, which overcome the hereinaforementioned disadvantages of the heretofore-known devices of this general type and in which the functionality of the shelf is improved.

With the foregoing and other objects in view there is provided, in accordance with the invention, a shelf for a domestic refrigeration appliance. The shelf has an upper cover plate and a lower cover plate which is separate therefrom. Moreover, the shelf has a frame which is separate from the cover plates. The cover plates are disposed in the frame. The cover plates are spaced apart from one another so that an intermediate space is formed between the cover plates. This intermediate space is configured as a thermally insulated space. Thus, it has a thermally insulating effect. The frame has at least one air channel which is separated from the intermediate space. The functionality of the shelf is enhanced by such an embodiment. Therefore, a medium, in particular a gaseous medium, may be conducted in a targeted manner through the air channel and conducted to desired positions in a targeted manner. The air channel is thus integrated in the shelf. In particular, the frame is configured in such a way that the air channel is defined by walls of the frame. Due to the air channel being separated from the intermediate space, the intermediate space is prevented from being compromised. As a result, the thermally insulating effect in the intermediate space is not compromised.

In one advantageous embodiment, it is provided that the frame has a multipart configuration and has an upper first frame part and a lower second frame part, wherein these two frame parts are positioned on top of one another and, in particular, sealingly connected together. Due to such an embodiment, the assembly and/or production of the shelf is simplified. The introduction of the cover plates and the construction of the air channel is simplified thereby. With an integral embodiment of the frame, the relevant production sequences are more complex, in particular for producing the intermediate space and the air channel, but the number of components of the shelf is reduced.

Preferably, it is provided that the two frame parts are configured to be of equal size. In a state disposed on top of one another and thus stacked, the frame parts are preferably configured to be congruent. Undesirable overhangs or edges, at the interfaces at which the frame parts are connected and bear directly against one another, may be avoided by such an embodiment.

Preferably, it is provided that the air channel is disposed in the plane of the shelf adjacent the cover plates and adjacent the intermediate space. In particular, therefore, when looking into the plane of the shelf in such a manner, the air channel is configured without overlapping the intermediate space. Through the use of such an embodiment, this air channel and the intermediate space do not mutually compromise one another and, at the same time, the overall height of the shelf may be reduced thereby. Thus, in this embodiment, the air channel does not partially extend above the intermediate space or below the intermediate space.

Preferably, it is provided that the air channel extends in a substantially linear manner between the longitudinal sides of the shelf. In particular, the shelf is configured to have corners, in particular to be quadrangular. In this case, the longitudinal sides form those sides of this quadrangular geometry which are longer than the two remaining sides. By providing such an embodiment of the air channel, this air channel is minimized in terms of length so that the shortest possible paths may also be formed for the medium flowing through the air channel. "In a substantially linear manner" in this case is intended to be understood to mean that a main direction of extent of the channel, i.e. a direction of extent which is significantly longer than the other directions of extent, extends in a linear manner.

Preferably, it is provided that the air channel opens with a first opening on a first longitudinal side of the shelf and preferably opens with a second opening on a second longitudinal side of the shelf. Therefore, when viewed in the longitudinal direction of the air channel, this air channel is provided at one end with an opening and is preferably provided with two openings at opposing ends, respectively configured on a longitudinal side of the shelf, preferably configured on opposing longitudinal sides of the shelf. The medium flowing in the air channel, therefore, may be conducted on a short path, for example directly between the two longitudinal sides.

Preferably, it is provided that the frame receives a first upper cover plate and a first lower cover plate, with a first intermediate space being formed therebetween. In the plane of the frame adjacent the first cover plate and the first intermediate space and separately there from, the frame receives a second upper cover plate and a second lower cover plate, with a second intermediate space being formed therebetween. Therefore, this is a further very advantageous embodiment, since two separate cover plates are produced, with the cover plates also being configured in particular in the plane of the shelf without overlapping, and with in each case an individual intermediate space being separately formed therebetween. It is possible that the first intermediate space is fluidically connected to the second intermediate space. However, it may be provided, in particular, that the first intermediate space and the second intermediate space are not fluidically connected. The first intermediate space and the second intermediate space, therefore, may constitute separate unconnected cavities. It is conceivable that the shelf is disposed in such a way that, when viewed in the height direction of a domestic refrigeration appliance, a partial volume of a receiving space, in which the shelf is disposed, is formed below this shelf. Due to this embodiment of the shelf, with the relatively wide and large receiving spaces, it may be possible to look through the shelf at different points, in particular if the cover plates are transparent. As a result, an extensive view may be possible into a still relatively large partial volume below the shelf. This is particularly advantageous if two separate food receiving containers are disposed in this partial volume of the receiving space, which is defined upwardly by the shelf. If one of these food receiving containers is disposed directly below the first pair of cover plates and the separate second food receiving container is disposed below the second pair of cover plates, in each case it is possible to look through the shelf into the interior of these two containers through the shelf.

Preferably, as viewed in series with the intermediate spaces, it is provided that the air channel is configured between these intermediate spaces. Through the use of such an embodiment, with a relatively central position of the air channel in the middle, the medium may be conducted very rapidly and over a short path in the air channel to different points. Thus, for example, in such an embodiment it may be provided that a medium, in particular a gaseous medium, may be conducted both in a partial region below the first pair of cover plates and in a partial region below the second pair of cover plates. Therefore, in addition to short flow paths, it is also possible for the medium flowing in the air channel to move into these partial regions in a more targeted manner.

In one advantageous embodiment, a vacuum is formed in the intermediate space, with the thermally insulating effect being produced thereby. This is an advantageous embodiment since this thermally insulated space is not filled with an additional physical material, such as for example insulation mats or an insulation foam. Advantageously, therefore, in particular when the cover plates are configured to be transparent, such a thermal insulation produced by the production of a vacuum permits an unrestricted view through the cover plates. Moreover, due to such an embodiment the weight of the shelf is minimized.

Preferably, the cover plates are configured to be transparent at least in regions. These cover plates may be preferably formed of genuine glass or plastics.

With the objects of the invention in view, there is also provided a domestic refrigeration appliance having a housing, with at least one receiving space for food being configured therein. The domestic refrigeration appliance has at least one shelf according to the aforementioned aspect of the invention or an advantageous embodiment thereof.

Preferably, the domestic refrigeration appliance has a cool air channel system, with the shelf being coupled thereto, so that cool air is able to be conducted by the cool air channel system into the air channel of the shelf. For example, this may be provided when the domestic refrigeration appliance is a No-Frost domestic refrigeration appliance.

It is also possible that the air channel is coupled to a fluid supply unit. This is advantageous when the shelf is a partial element of a keep-fresh container. Such a keep-fresh container preferably has a tray and/or trough as a food receiving container. This tray is covered from above by a lid which may be formed by the shelf. As a result, a keep-fresh container is produced which has a separate partial volume in which an individual storage condition may be set. This storage condition may be individually the temperature and/or the humidity content. In particular, it is thus possible that a storage condition is set in the keep-fresh container which is different and independent of the storage condition of a food receiving space of the domestic refrigeration appliance. However, at the same time this keep-fresh container may still be disposed in the receiving space. The fluid supply unit is provided in order to permit this individual setting of a humidity content. This fluid supply unit may also be configured for producing a fluid mist which then may be introduced into the keep-fresh container. This may also be implemented through the air channel in the shelf. In particular, two separate keep-fresh containers may also be configured in this case, with the keep-fresh containers having two separate trays and also together including the shelf. Thus, the embodiment of the central position of the air channel in the middle is advantageous in order to be able to supply the media individually into both trays and thus into both keep-fresh containers.

A further independent aspect of the invention relates to a shelf for a domestic refrigeration appliance. The shelf has an upper cover plate and a separate lower cover plate. The shelf also has a frame separate from the cover plates in which the cover plates are disposed. The cover plates are spaced apart from one another so that an intermediate space is formed between the cover plates, with the intermediate space being formed as a thermally insulated space. The frame has a first upper cover plate and a first lower cover plate. A first intermediate space is formed as a thermally insulated space between these cover plates. In the plane of the frame adjacent the first cover plates with the first intermediate space and separately therefrom, the frame has a second upper cover plate and a second lower cover plate, with a second intermediate space being formed therebetween as a thermally insulated space. The relevant cited advantages thereof have already been disclosed in the advantageous embodiment relative to the first-mentioned aspect of the invention.

Embodiments of the first-mentioned aspect of the shelf are to be regarded as advantageous embodiments of this second independent aspect of the shelf.

The positions and orientations provided when the shelf and/or the appliance is used as intended and disposed as intended are specified by the terms "above," "below," "front," "rear," "horizontal," "vertical," "depth direction," "width direction," "height direction," etc.

Further features of the invention are disclosed in the claims, the figures and the description of the figures. The features and combinations of features cited above in the description, and the features and combinations of features cited hereinafter in the description of the figures and/or shown individually in the figures, are not only able to be used in the respectively specified combination but also in other combinations or individually, without departing from the scope of the invention. Thus, embodiments of the invention which are not explicitly shown and described in the figures but which are disclosed and may be produced by separate combinations of features from the described embodiments are also to be regarded as encompassed and disclosed. Embodiments and combinations of features which do not include all of the features of an originally formulated independent claim are thus also to be regarded as disclosed.

Other features which are considered as characteristic for the invention are set forth in the appended claims.

Although the invention is illustrated and described herein as embodied in a shelf for domestic refrigeration appliance and a domestic refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
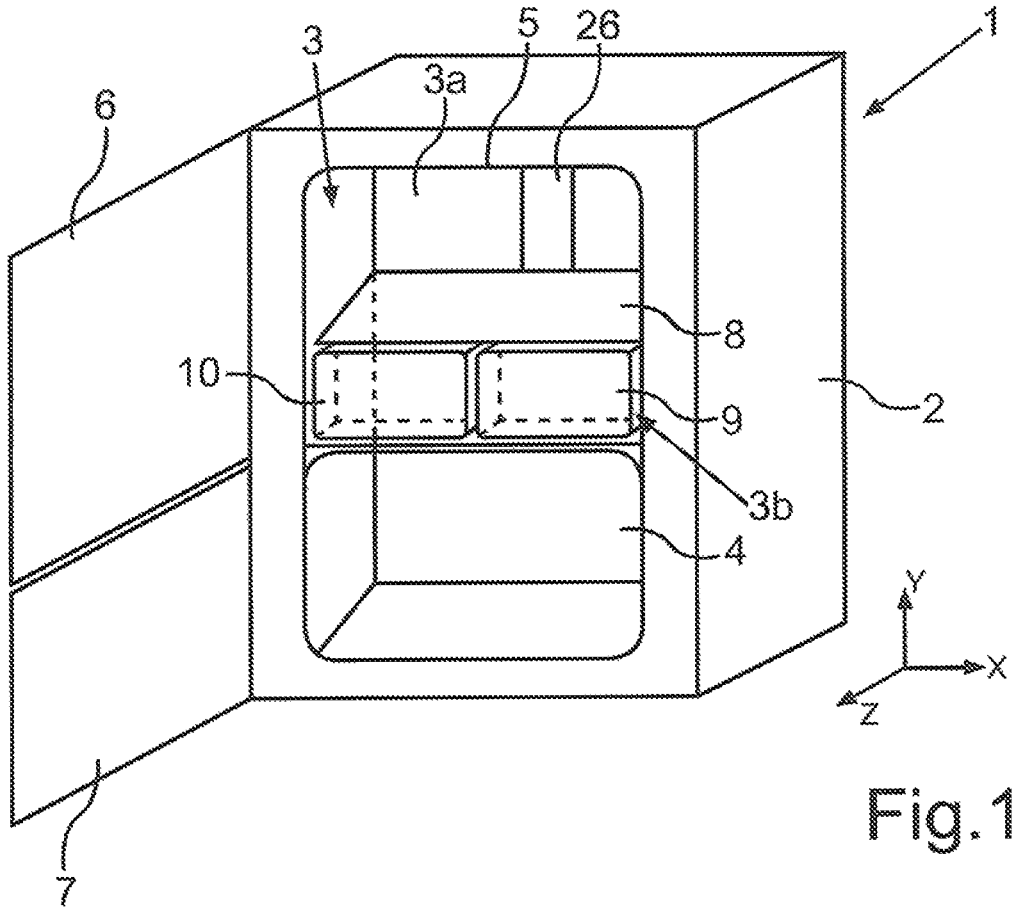
FIG. 1 is a diagrammatic, perspective view of an exemplary embodiment of a domestic refrigeration appliance according to the invention.

Referring now in detail to the figures of the drawings, in which elements that are the same or functionally the same are provided with the same reference characters, and first, particularly, to FIG. 1 thereof, there is seen a domestic refrigeration appliance 1 which is configured for storing and conserving food. The domestic refrigeration appliance 1 may be a refrigerator or a freezer or a combined refrigerator-freezer. The domestic refrigeration appliance 1 has a housing 2 in which at least one receiving space for food is configured. In the exemplary embodiment a first receiving space 3, which may be a refrigeration compartment, is provided. By way of example, a separate second receiving space 4, which may be a freezer compartment, is provided. The two receiving spaces 3 and 4 are defined by walls of an internal container 5. Moreover, in the described exemplary embodiment the domestic refrigeration appliance 1 has a first door 6 which is configured for closing the receiving space 3. This first door 6 is pivotably disposed on the housing 2. A second door 7 which is separate from the first door 6 is also pivotably disposed on the housing 2 and is provided for closing the further receiving space 4.

As may be identified in the view in FIG. 1, by way of example it may be understood that at least one separate and removable shelf 8 is disposed in the receiving space 3. The shelf 8 extends over the entire width of the receiving space 3, wherein this width is to be understood as being in the width direction (x-direction) of the domestic refrigeration appliance 1. Moreover, this shelf 8 extends at least substantially over a large part of the depth (depth direction in the z-direction) of the receiving space 3. The shelf 8 is configured as a plate.

By way of example and not to be understood as limiting in the exemplary embodiment shown, a first container 9 is disposed in the height direction (y-direction) directly below the shelf 8 in the receiving space 3. It may be provided that this container 9 extends over the entire width of the receiving space 3. In the exemplary embodiment shown, it is provided that adjacent this first container, which is a food receiving container, a separate second container 10 which is also a food receiving container is disposed in the width direction. The two containers 9 and 10 are disposed at the same height in the height direction.

The shelf 8 is also configured, in particular, as a thermally insulating partition. Thus, in an advantageous embodiment an upper first partial region 3*a* of the receiving space 3 is also thermally insulated from a second partial region 3*b* located there below. In an advantageous embodiment the containers 9 and 10 are disposed in this second partial region 3*b*. These containers 9 and 10 are preferably configured as trays and/or troughs.

Figure 2:
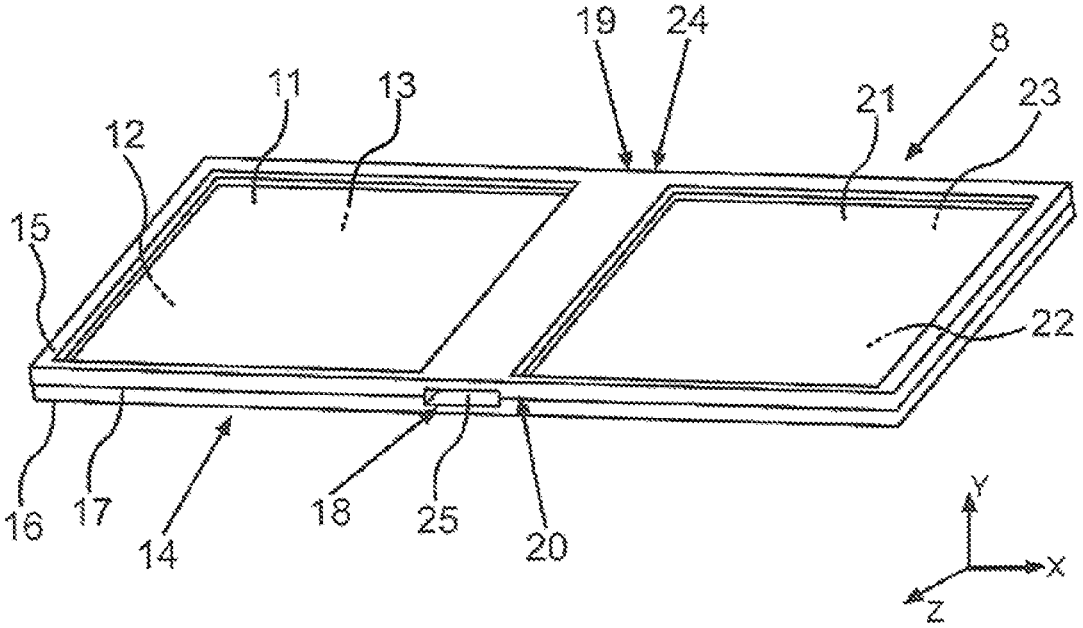
FIG. 2 shows a perspective view of an exemplary embodiment of a shelf.

An exemplary embodiment of a shelf 8 is shown in a perspective view in FIG. 2. The shelf 8 has a first upper cover plate 11 and a first lower cover plate 12 disposed there below in the height direction and spaced apart therefrom. The two cover plates 11 and 12 preferably have a quadrangular configuration. The cover plates 11 and 12 are preferably configured to be transparent at least in regions thereof. The cover plates 11 and 12 are preferably formed of genuine glass.

An intermediate space 13 (FIG. 3) is formed between the first upper cover plate 11 and the first lower cover plates 12. This intermediate space 13 is configured as a thermally insulated space. This means that it has a thermally insulating effect. It is thus provided that physical thermally insulating material is introduced into this intermediate space 13. In an advantageous alternative, it is provided that a vacuum is produced in this intermediate space 13 so that this thermally insulating effect is present.

The shelf 8 also has a frame 14 which surrounds, in particular fully encompasses, the cover plates 11 and 12 on the periphery. The frame 14, in particular, has a multipart configuration, preferably a two-part configuration. It has a first frame part 15 and a separate second frame part 16. In particular, the two frame parts 15, 16 are configured to be of equal size and to bear directly against one another. At a connecting point and/or interface 17 they are releasably connected in a non-destructive manner, for example bonded or welded together. In particular, the frame parts 15 and 16 are configured in each case as integral or one-piece plastics parts.

In particular, it is provided that the shelf 8 includes at least one channel 18 which, in particular, is a flow channel for gaseous or liquid media. In particular, the channel 18 is an air channel. The channel is configured separately from the intermediate space 13. When looking into the plane of the shelf 8, which corresponds to the x-y-plane, the channel 18 is configured so as not to overlap with the intermediate space 13.

Preferably, the channel 18 extends from a first longitudinal side 19 of the shelf 8 to a second longitudinal side 20 of the shelf 8 which in this respect opposes the first longitudinal side 19. The two longitudinal sides 19 and 20, viewed in the depth direction, are the rear longitudinal side and the front longitudinal side. These longitudinal sides 19 and 20, therefore, extend in the width direction of the domestic refrigeration appliance 1.

In this regard, a shelf 8 may be correspondingly configured as has been described above.

In a further advantageous embodiment, it is provided that the shelf 8 is configured as shown in FIG. 2. In this embodiment, in addition to the first upper cover plate 11 and the first lower cover plate 12, the shelf 8 has a separate further second upper cover plate 21 and a separate second lower cover plate 22. A further second intermediate space 23, which is a thermally insulated space, is configured between these two cover plates 21 and 22, which in turn are positioned directly superimposed on one another and spaced apart from one another in the height direction. This thermally insulated space is also preferably configured for the thermally insulating effect by a vacuum being produced.

As may be identified in the embodiment according to FIG. 2, the cover plates 11 and 21 and 12 and 22, viewed in the plane of the shelf 8, are disposed so as not to overlap one another and are configured in this plane. In particular, it is provided that the channel 18 is disposed between these pairs of cover plates. In this connection, when viewed in the plane of the shelf 8, the channel 18 is also configured so as not to overlap with the intermediate space 23.

The channel 18 has openings 24 and 25 at its opposing ends, viewed in the longitudinal direction of the channel 18. With these openings, the channel may be individually coupled to other media-conducting systems of the domestic refrigeration appliance 1. For example, a cool air channel system 26 (FIG. 1) may be cited in this case. In this connection, the channel 18 may be coupled, for example, with its rear opening 24 to this cool air channel system 26 so that cool air may also flow through the channel 18. The channel 18 may be closed on the periphery over its entire length, as shown in FIG. 2, and may only be open at these two openings 24 and 25. However, it may also be provided that along this length of the channel 18 a further opening is configured on the upper face and thus on the upper frame part 15 and/or on the lower face and thus on the lower frame part 16. As a result, in advantageous embodiments, at targeted positions a medium may also be discharged upwardly or downwardly and thus above the shelf 8 and below the shelf 8. In a further embodiment, it is also possible for the opening 25 not to be present and thus for the channel 18 to be closed on the front face. This is possible if, as already mentioned above, at least one opening is configured on the upper frame part 15 and/or at least one opening is configured on the lower frame part 16 so that a medium may be discharged upwardly or downwardly in a targeted manner. The examples may also be combined in many ways.

Additionally or alternatively, the channel 18 may also be coupled to a fluid supply unit of the domestic refrigeration appliance 1. This may be provided if the domestic refrigeration appliance 1 has a keep-fresh container. Such a keep-fresh container may, for example, be formed by the container 9 and the shelf 8. As a result, a self-contained partial volume is created which is separate from the receiving space 3, in particular also the partial volume 3*a*. Through the use of such a keep-fresh container the storage of individual foods is possible since in this keep-fresh container different storage conditions may be set independently of the remaining receiving space 3. Thus, in this connection, a fluid mist may also be introduced through the fluid supply unit, for example, in order to be able to maintain the freshness of the food stored therein longer. Moreover, as described in the example of FIG. 1, two separate keep-fresh containers may be configured, one thereof being formed by the container 9 and the shelf 8 and the other being formed by the container 10 and the shelf 8.

Figure 3:
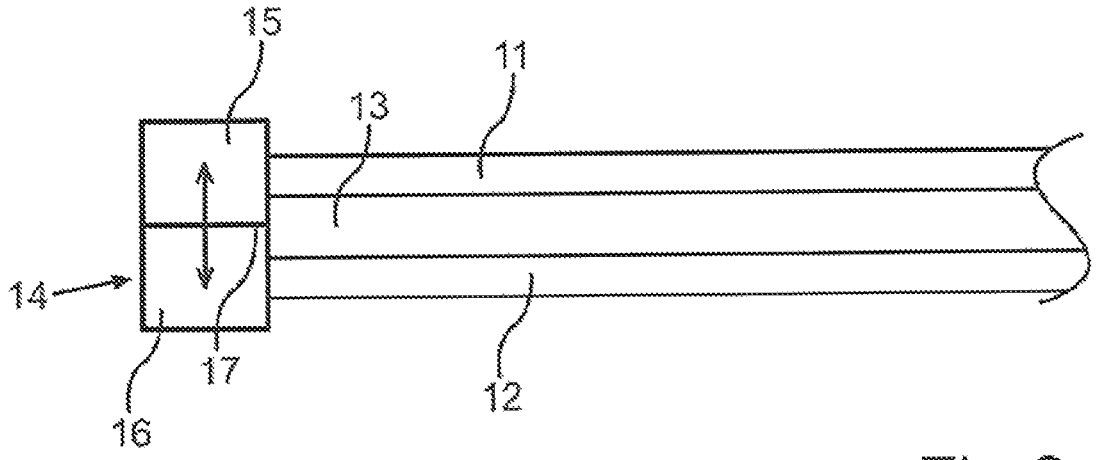
FIG. 3 shows a simplified sectional view through a partial region of an exemplary embodiment of a shelf.

In FIG. 3, a diagrammatic, sectional view through the shelf 8 according to FIG. 2 is shown in the region of the cover plates 11 and 12.

It may be provided that the cover plates 11 and 12 are produced and connected to the frame parts 15 and 16 by an injection-molding method, in particular they are produced by a two-component injection-molding.

It may be provided that an upper face of an upper cover plate 11, 21 is flush with the upper face of a frame part 15. The same may be provided for the cover plates 12 and 22 with the frame part 16. Similarly, in one embodiment there may be a height difference between an upper cover plate 11, 21 and the upper face of the frame part 15. The same may be provided for the cover plates 12, 22 relative to the frame part 16.

The following is a summary list of reference numerals and the corresponding structure used in the above description of the invention. List of reference characters:

1 Domestic refrigeration appliance
2 Housing
3 Receiving space
3*a* First partial region
3*b* Second partial region
4 Receiving space
5 Internal container
6 Door
7 Door
8 Shelf
9 Container
10 Container
11 Cover plate
12 Cover plate
13 Intermediate space
14 Frame
15 First frame part
16 Second frame part
17 Interface
18 Air channel
19 First longitudinal side
20 Second longitudinal side
21 Cover plate
22 Cover plate
23 Intermediate space
24 Opening
25 Opening
26 Cool air channel system

The invention claimed is:

1. A shelf for a domestic refrigeration appliance, the shelf comprising:
an upper cover plate and a lower cover plate;
said cover plates forming an intermediate space therebetween as a thermally insulated space having a vacuum formed in said intermediate space producing a thermally insulating effect;
a frame in which said cover plates are disposed; and
a channel for conducting media, said channel being formed in said frame separately from said intermediate space.

2. The shelf according to claim 1, which further comprises longitudinal sides of the shelf, said channel extending in a substantially linear manner between said longitudinal sides of the shelf.

3. The shelf according to claim 1, wherein:
said frame is disposed in a plane;
said intermediate space is one of first and second intermediate spaces;
said cover plates include a first upper cover plate and a first lower cover plate received in said frame in said plane of said frame and having said first intermediate space formed therebetween;
said cover plates include a second upper cover plate and a second lower cover plate received in said frame in said plane of said frame and having said second intermediate space formed therebetween; and
said second upper cover plate, said second lower cover plate and said second intermediate space being respectively adjacent and separate from said first upper cover plate, said first lower cover plate and said first intermediate space.

4. The shelf according to claim 1, wherein said cover plates are transparent.

5. The shelf according to claim 1, wherein said cover plates are formed of genuine glass or plastics.

6. The shelf according to claim 1, wherein said frame has a multipart configuration including an upper first frame part and a lower second frame part being are positioned on top of one another and sealingly connected together.

7. The shelf according to claim 6, wherein said frame parts are of equal size.

8. The shelf according to claim 1, wherein the shelf is disposed in a plane, and said channel is disposed in said plane of the shelf alongside said cover plates and alongside said intermediate space.

9. The shelf according to claim 3, wherein said channel is disposed between said intermediate spaces and in series with said intermediate spaces.

10. The shelf according to claim 1, which further comprises first and second longitudinal sides of the shelf, said channel having a first opening on said first longitudinal side of the shelf.

11. The shelf according to claim 10, wherein said channel has a second opening on said second longitudinal side of the shelf.

12. A domestic refrigeration appliance, comprising:

a housing;

at least one receiving space for food being disposed in said housing; and at least one shelf according to claim 1 being disposed in said at least one receiving space.

13. The domestic refrigeration appliance according to claim 12, which further comprises a cool air channel system coupled to said shelf to permit cool air to be conducted by said cool air channel system into said channel of said shelf.

* * * * *